United States Patent [19]

Reid

[11] 4,314,465

[45] Feb. 9, 1982

[54] PELT FAT REMOVAL APPARATUS

[76] Inventor: Melville R. Reid, R.R. #6, Guelph, Ontario, Canada, N1H 6J3

[21] Appl. No.: 109,368

[22] Filed: Jan. 3, 1980

[30] Foreign Application Priority Data

Aug. 17, 1979 [CA] Canada ..... 334043

Related U.S. Application Data

[63] Continuation-in-part of Ser. No. 968,185, Dec. 11, 1978, abandoned.

[51] Int. Cl.[3] ..... C14B 17/00

[52] U.S. Cl. ..... 69/40; 69/46

[58] Field of Search ..... 17/21; 69/39, 40, 42, 69/43, 45, 46

[56] References Cited

U.S. PATENT DOCUMENTS

| | | | |
|---|---|---|---|
| 2,942,448 | 6/1960 | Jonas | 69/46 |
| 3,048,995 | 8/1962 | Browning | 69/46 |
| 3,049,906 | 8/1962 | Mills | 69/46 |

*Primary Examiner*—Willie G. Abercrombie

*Attorney, Agent, or Firm*—Moss, Bensette, Thompson, Squires

[57] ABSTRACT

Improved apparatus is disclosed for increasing the output of a machine for removing fat from the inside of an animal pelt, such as a mink pelt. In such machines, pelts are mounted inside out on rotatable elongate mandrils, and a cutting head resembling a router trims the fat from the pelt. The improvement includes a control assembly attached to the cutting head for pivotal movement thereof to control the depth of cut. The control assembly has a flexible extension which permits the cutting head to move freely longitudinally along the mandril. The control assembly also has a toggle joint and a lever operably coupled thereto to reduce the effort of pivoting the cutting head. The depth of cut is therefore controlled with reduced effort using a lever in a fixed location on the machine. A reciprocating element controls the longitudinal position of the cutting head. The reciprocating element is operated by foot controlled drive means including a motor driven reversing clutch. Also, stops disengage the clutch to limit longitudinal movement of the cutting head therebeyond.

15 Claims, 7 Drawing Figures

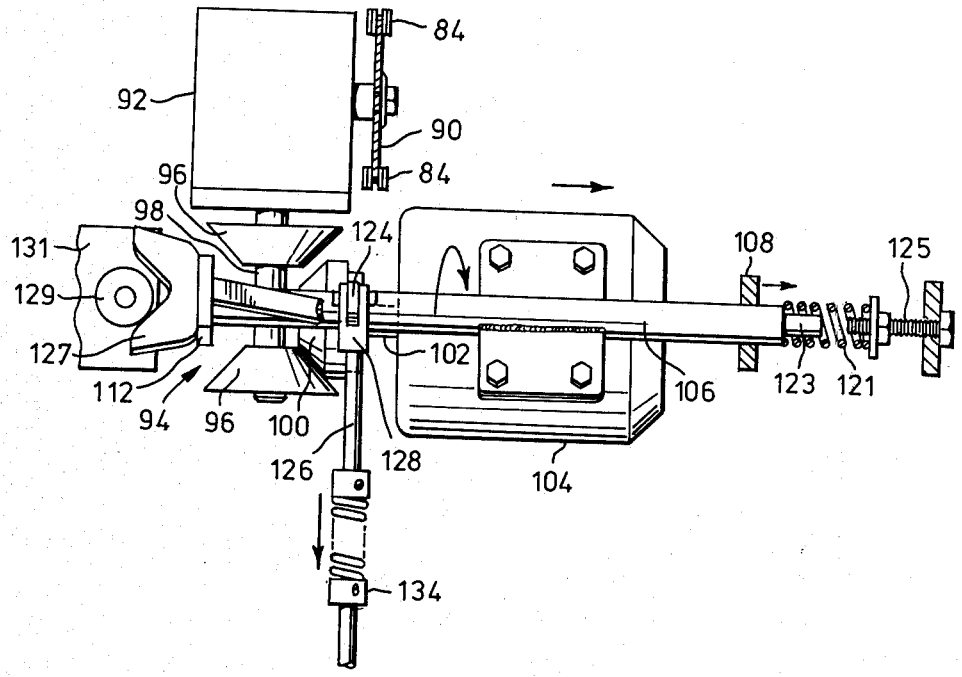
FIG. 7
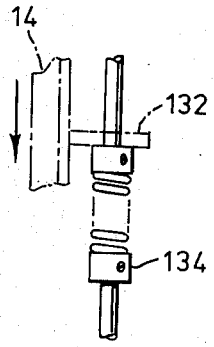

PELT FAT REMOVAL APPARATUS

This application is a continuation-in-part of my Application Ser. No. 968,185, filed Dec. 11, 1978, entitled IMPROVED PELT FAT REMOVAL APPARATUS, now abandoned.

This invention relates to machines for removing fat from the inside of animal pelts, and in particular, to improved apparatus for controlling the operation of these machines.

Animals, such as mink, have a layer of fat lining the inside of their pelts. In order to process such pelts for the fur trade, it is necessary to remove this layer of fat. A common type of machine used for this purpose has one or more conical mandrils on which the pelts are mounted, inside out, in order to expose the fat to be removed. The mandrils are rotatable and are horizontally mounted on a machine frame. The machine frame supports a router-like cutting head mounted on a dolly for longitudinal movement adjacent to the mandril. The cutting head includes a cutter or bit which engages and planes or cuts off the pelt fat.

It will be appreciated, therefore, that the cutting head moves both longitudinally along the mandril and transversely of the mandril to vary the depth of cut. In the past, the cutting head has been moved manually by a machine operator by grasping a handle attached directly to the cutting head. Since considerable force is required to be applied to this handle to control the cutting head, operator fatigue has been an important factor in limiting the production from these machines. Further, operators of these machines in the past have found it necessary to remain standing while operating the machines, because it is necessary to move along the mandrils to correctly position the cutting head.

In the present invention, an operator may remain in a stationary position and control the cutting head using foot and hand controls which require minimal physical effort. While this reduces operator fatigue and increases production, the operator still has sufficient manual "feel" to perform the fat removal operation effectively.

According to one aspect of the invention, in a machine for removing fat from the inside of an animal pelt, the machine having a rotatable elongate mandril for mounting the pelt inside out thereon, a motor driven pelt engaging cutting head mounted on a dolly on the machine frame for longitudinal movement adjacent to the mandril, and the cutting head being pivotally mounted on the dolly for transverse adjustment of the depth of the cut, there is provided apparatus for controlling the movement of the cutting head. The apparatus comprises a control assembly adapted to be connected between the machine frame and the cutting head for pivotal movement of the cutting head relative to the dolly. The control assembly includes a longitudinally rigid control member for connection to the cutting head, the control member including a transversely flexible extension portion and a remote end portion. A toggle joint is operatively connected to the remote end portion to move the control member longitudinally and thus pivot the cutting head. Also, a lever is operably attached to the toggle joint.

According to another aspect of the invention, in a machine for removing fat from the inside of an animal pelt, the machine having a rotatable elongate mandril for mounting the pelt inside out thereon, a motor driven pelt engaging cutting head mounted on a dolly on the machine frame for longitudinal movement adjacent to the mandril, and the cutting head being pivotally mounted on the dolly for transverse adjustment of the depth of cut, there is provided apparatus for controlling the movement of the cutting head. This apparatus comprises a reciprocating element adapted to be connected to the dolly for longitudinal movement thereof. Drive means is operably connected to the reciprocating element, the drive means including a motor and a reversing clutch coupled between the motor and the reciprocating element. Means is operatively coupled to the clutch for engagement thereof to move the reciprocating element in alternative directions. Also, stops are arranged to limit the longitudinal movement of the dolly, the stops being operatively connected to the clutch, so that upon contact of the stops by the dolly, the clutch is disengaged to prevent movement of the dolly past the stops.

A preferred embodiment of the invention will now be described, by way of example, with reference to the accompanying drawings, in which:

FIG. 7 is a plan view similar to FIG. 6 illustrating the operation of the reversing clutch.

Figure 1:
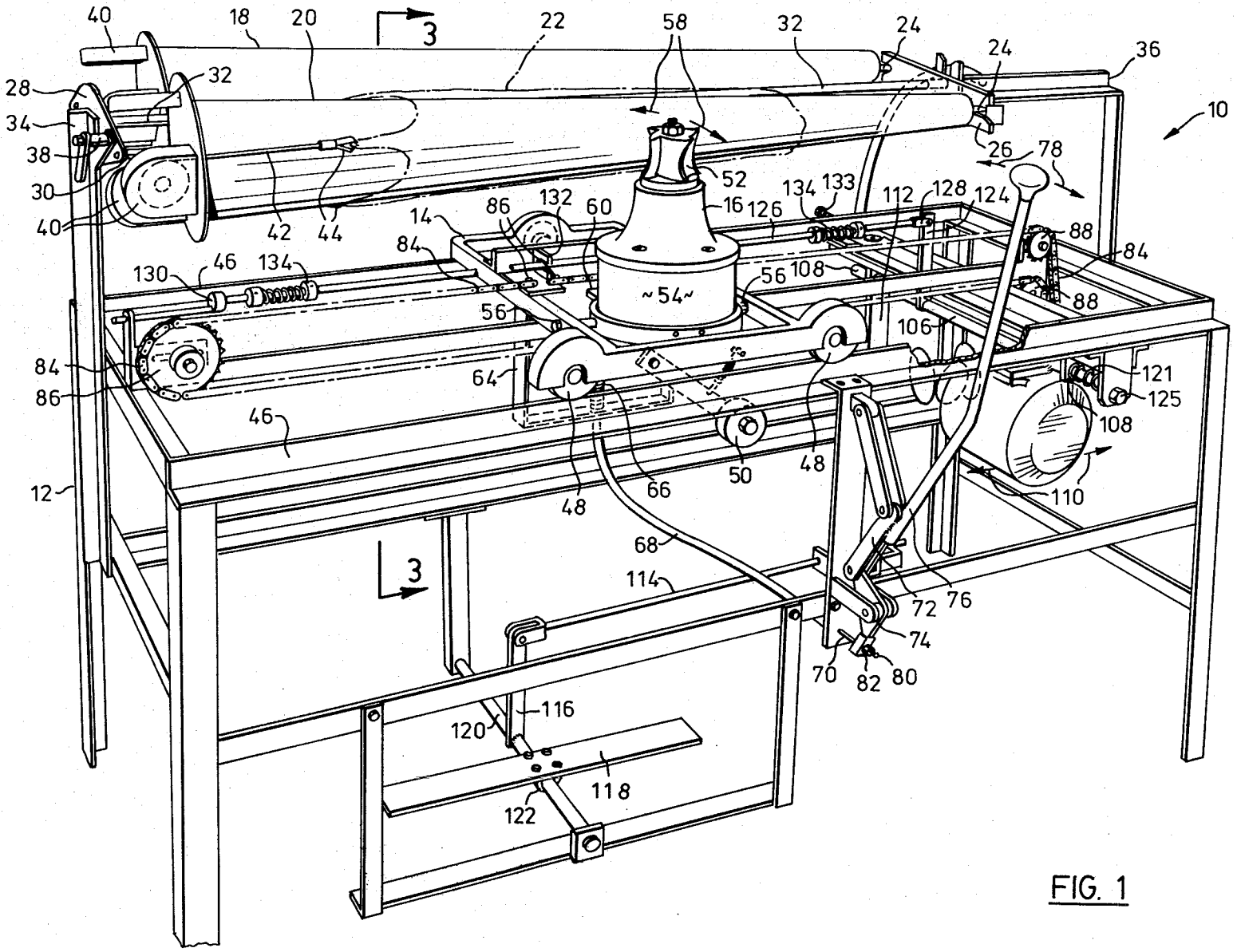
FIG. 1 is a perspective view of a machine for removing fat from the inside of an animal pelt, the machine incorporating the improved control apparatus of the present invention.
Figure 2:
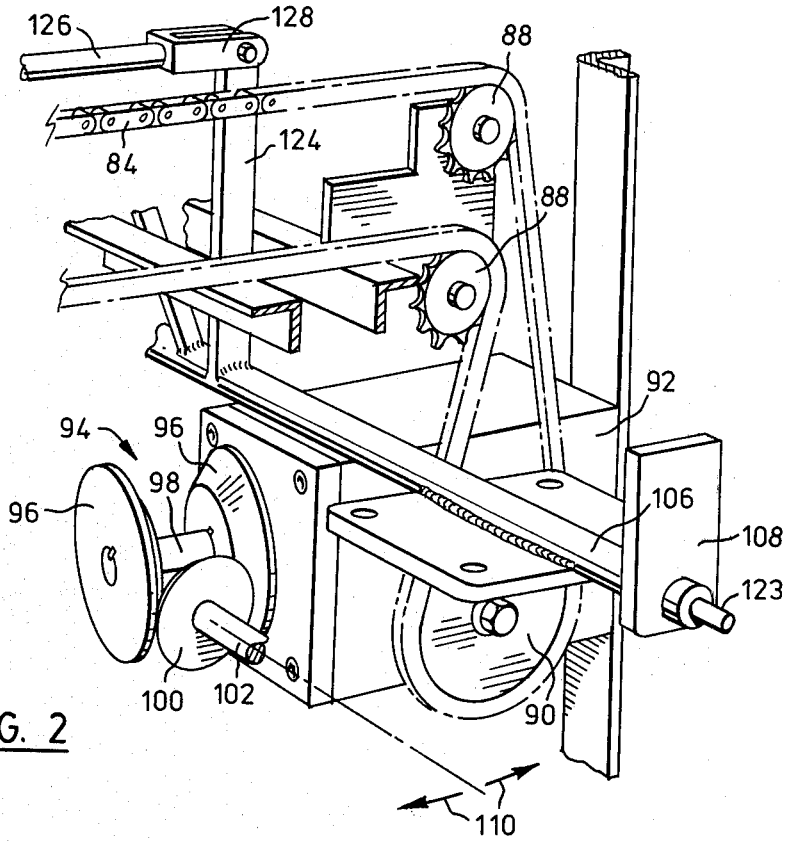
FIG. 2 is a perspective view of a portion of the drive means of the control apparatus of the machine shown in FIG. 1, with some parts removed for the purpose of illustration.

Referring to the drawings, a pelt fat removal machine is generally indicated by reference numeral 10. Machine 10 includes a base or frame 12 and a dolly 14 mounted for horizontal movement on frame 12. A motor driven cutting head 16 is pivotally mounted on dolly 14. Also, a pair of mandrils 18, 20 is rotatably mounted above dolly 14. A pelt 22, diagrammatically represented by chain-dotted lines in FIG. 1, is shown mounted on mandril 20. In operation, cutting head 16 is pivoted into engagement with pelt 22, and dolly 14 is moved longitudinally along mandril 20, so that cutting head 16 removes or cuts away the fat from the pelt.

Machine frame 12, dolly 14 and mandrils 18, 20 are conventional and are not considered to be part of the present invention, and therefore will not be described in great detail. However, these elements will now be described briefly for a proper understanding of the operation of the preferred embodiments of the invention.

Mandrils 18, 20 are hollow, conical members approximately 5 to 6 feet in length. Axially disposed spindles 24 are attached to the narrow ends of mandrils 18, 20 for rotational mounting of the mandrils in a retaining plate 26. An opposed retaining plate 28 is located at the wide ends of mandrils 18, 20. Retaining plate 28 has a pair of parallel axles 30, which extend into openings in the wide ends of mandrils 18, 20, also for rotational mounting of the mandrils. Retaining plates 26, 28 are connected together by a central shaft 32, which is rotatably mounted in opposed upright frame members 34, 36, thus enabling mandrils 18, 20 to rotate as a unit about central shaft 32. A detent type of stop 38 releasably retains the mandrils in a horizontal, side-by-side position. Further, the wide ends of the mandrils are provided with spring loaded reels 40 containing cables 42 having end clips 44 for grasping the pelts and retaining same on the mandrils. The axes of mandrils 18, 20 are arranged so that the side of the front mandril 20 facing cutting head 16 is disposed parallel to the direction of travel of dolly 14.

It will be appreciated, that the mandrils may be removed from the machine 10 by releasing spindles 24 from retaining plate 26 and pulling the mandrils longitudinally off axles 30. In use of machine 10, the mandrils are normally just released at the narrow ends to permit a pelt to be slipped on and off the mandrils. In fact, while the fat is being removed from the pelt on the front mandril 20, the rear mandril 18 is released to permit the removal of a previously processed pelt and the mounting of a fresh unprocessed pelt. When the fat has been removed from the pelt on the front mandril 20, the mandril assembly is rotated 180 degrees, bringing a new pelt into position for fat removal and enabling the previously processed pelt to be replaced with a fresh pelt. In practise, one operator operates cutting head 16 to remove the fat from the pelts, while a second operator manipulates rear mandril 18 to replace processed pelts with unprocessed pelts.

Machine frame 12 is in the configuration of a table or work bench and is formed of steel angle stock. Frame 12 includes a pair of side rails 46, which support rollers 48 of dolly 14. Spring biased retaining rollers 50 are attached to dolly 14 and bear against the undersides of side rails 46 to prevent dolly 14 from becoming derailed unintentionally.

Figure 3:
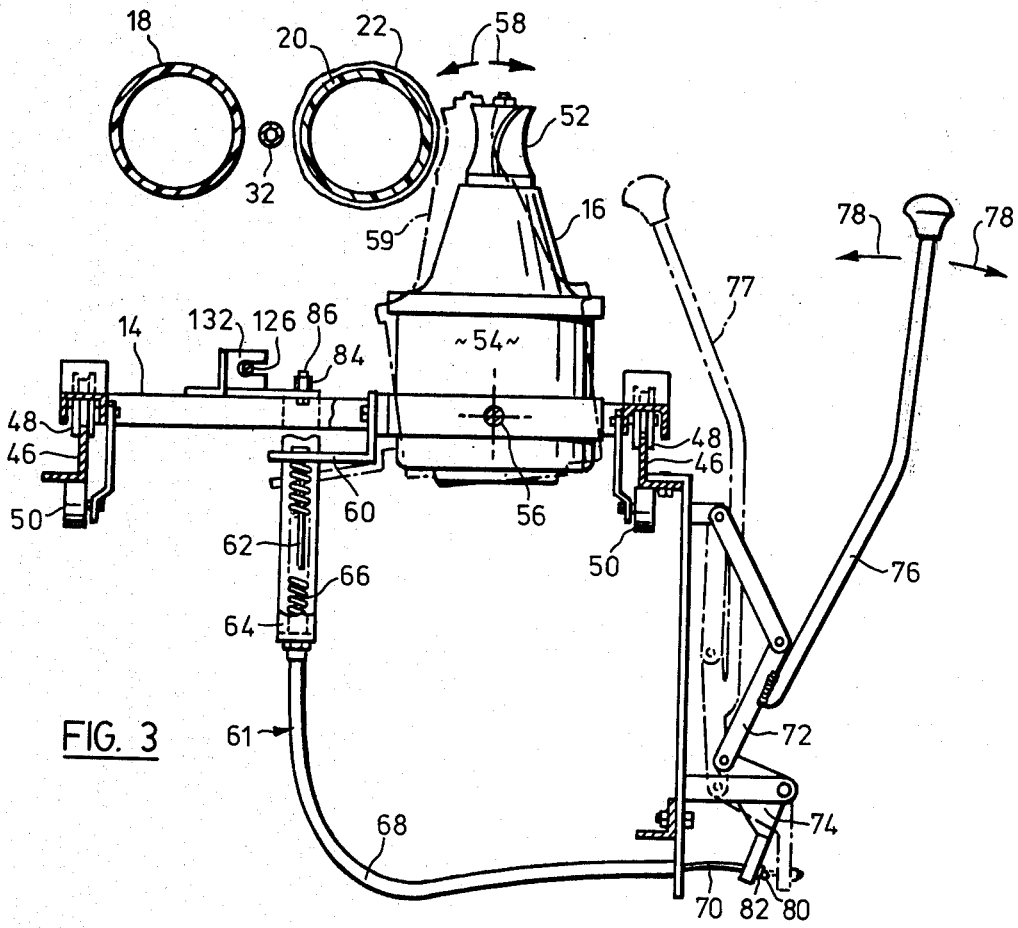
FIG. 3 is a vertical sectional view taken along lines 3—3 of FIG. 1, again with some parts removed for the purpose of illustration.

Referring, in particular, to FIGS. 1 and 3, the apparatus for controlling the depth of cut of cutting head 16 will now be described in detail. Cutting head 16 includes a cutter or bit 52, and a motor 54. Bit 52 is mounted on the arbor of motor 54, much like a conventional router. Ordinarily, a safety shield or guard (not shown) is placed over cutting bit 52, and a vacuum attachment is connected to the guard to remove the fat cut off pelt 22. Motor 54 is pivotally mounted on dolly 14 by pivot pins 56, so that cutting head 16 pivots as indicated by arrows 58 and the chain-dotted lines 59 in FIG. 3. It will be appreciated that the pivoting of cutting head 16 controls the depth of cut of bit 52. A bracket 60 is attached to motor 54, and a control assembly 61 is connected between machine frame 12 and bracket 60 of cutting head 16. Control assembly 61 includes a longitudinally rigid control member 62 connected to the bracket 60 of cutting head 16. Control member 62 is in the form of a flexible cable which slidably passes through a U-shaped frame member 64 (see FIG. 1) which is part of dolly 14. A spring 66 is concentrically mounted on control member 62 between frame member 64 and bracket 60 to bias bracket 60 upwardly. It will be appreciated, therefore, that spring 66 biases cutting head 16 away from pelt 22. Control member 62 also includes a transversely flexible extension portion 68 and a remote end portion 70 slidably attached or mounted on machine frame 12. Flexible extension 68 permits dolly 14 to move back and forth on frame 12 without affecting the adjustment of the depth of cut of cutting head 16.

A toggle joint 72 is operatively connected to end portion 70 of cable 62 through a pivot link 74. A lever 76 is attached to the lower element of toggle joint 72, so that movement of lever 76 in the directions of arrows 78 causes cutting head 16 to move in the respective directions of arrows 58. The mechanical advantage achieved by toggle joint 72 permits relatively high forces to be transmitted through cable 62 and correspondingly high pressures to be exerted by cutter bit 52 on pelt 22, and yet only relatively low forces must be applied to lever 76 by an operator.

As indicated in FIG. 3 by chain-dotted lines 77, the toggle joint 72 is movable from an open position shown in solid lines to an over-the-centre closed position indicated by the chain-dotted lines. When in the open position, the weight of lever 76 also biases cutting head 16 away from pelt 22. The lever 76 is attached to toggle joint 72 such that the engagement of lever 76 with remaining parts of toggle joint 72 provides means for limiting the movement of lever 76 in the closed position. This results in very positive location of the cutter bit 52 relative to the pelt 22 or mandril 20, and reduces operator fatique caused by backlash of cutting head 16. The remote end portion 70 of cable 62 includes a threaded stem 80 and a nut 82 for adjusting the effective length of control member or cable 62, and thus the position of the cutter bit 52 relative to mandril 20. In other words, remote end portion 72 is adjustably connected to toggle joint 72 for adjustment of the position of cutting head 16.

Referring next, in particular, to FIGS. 1, 2 and 4 to 7, drive means for moving dolly 14 longitudinally adjacent to mandril 20 will now be described. A drive chain 84 is attached to dolly 14 by bolts 86 and forms a reciprocating element for longitudinal movement of the dolly. Drive chain 84 passes around an adjustable sprocket 86 (see FIG. 1) for adjusting the tension in the chain, idler or guide sprockets 88, and a driving sprocket 90, which in turn is mounted on the output shaft of a reducing gear box 92. Driving sprocket 90 represents the low speed output of gear box 92, the high speed input of the gear box being coupled to a reversing clutch 94. Clutch 94 includes a pair of opposed conical driven members 96 attached to input shaft 98 of gear box 92, and an intermediate mating driving member 100 attached to the arbor or output drive shaft 102 of a motor 104. The driven members 96 of clutch 94 are formed of steel, and driving member 100 is formed of a urethane rubber or other resilient material to produce good frictional contact therebetween. Driving member 100 is generally conical or hemispheroidal for this purpose as well. Motor 104 is mounted on a pivot shaft 106, which is rotatably mounted in suitable bearing blocks 108 attached to machine frame 12. Motor 104 is thus pivotally mounted for movement in the direction of arrows 110, and this pivotal movement causes clutch 94 to be engaged by alternative contact of driven members 96 by driving member 100. It will be apparent that this alternative contact causes chain 84 to reciprocate, moving cutting head 16 back and forth along pelt 22.

The means will now be described for operating or engaging clutch 94 to cause alternative contact of driven members 96 by driving member 100, thus movement of chain 84 in opposite directions. As mentioned above, reversing clutch 94 is operated by the pivoting of motor 104, and for this purpose, a series of links 112, 114 and 116 are connected between pivot shaft 106 and a foot pedal 118 (see FIG. 4). Link 112 is welded to pivot shaft 106. Link 116 is welded to a cross shaft 120, and link 114 is pivotally connected at opposed ends to links 112, 116. Foot pedal 118 is attached to cross shaft 120 by U-bolts 122, so that the transverse, or in and out position of foot pedal 118 is adjustable to suit the operator. It will be apparent from FIG. 4, that depression of the right hand side of foot pedal 118 causes the links 112, 114, 116 to move and motor 104 to pivot in one direction as indicated by the arrows, and depression of the left side of foot pedal 118 causes motor 104 to pivot in the opposite direction. Gear box 92 is chosen with suitable drive rotation so that depression of the right side of foot pedal 118 causes cutting head 16 to move to the right, and depression of the left side of foot pedal 118 causes cutting head 16 to move to the left.

Figure 5:
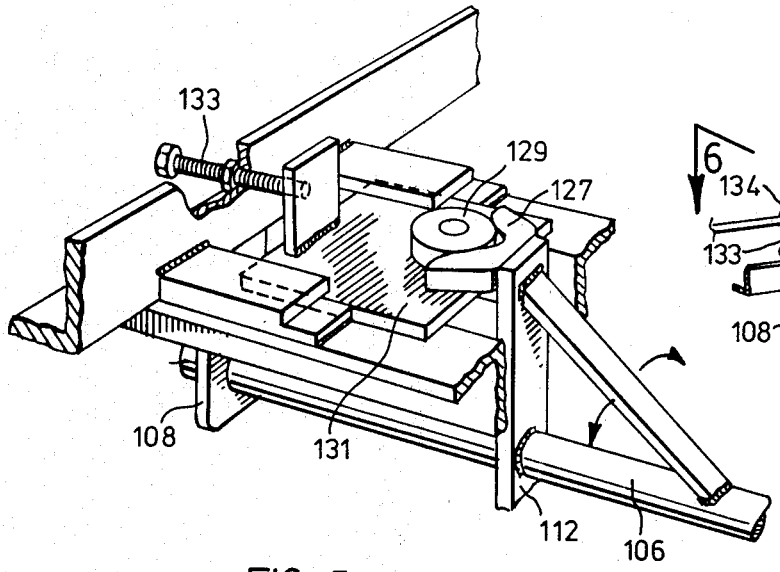
FIG. 5 is an enlarged prospective view of a portion of the apparatus of FIG. 4, illustrating the V-shaped cam portion of the clutch disengagement bias means.
Figure 4:
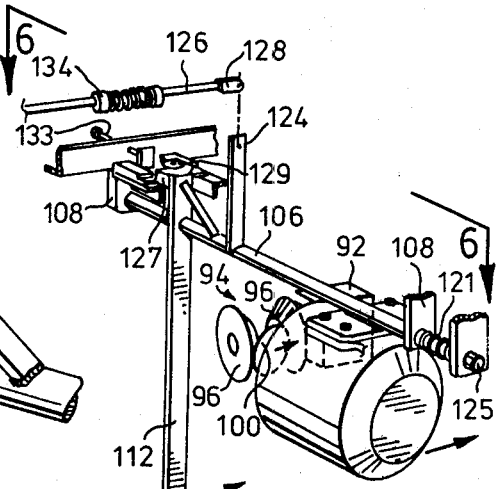
FIG. 4 is a prospective view of a portion of the control apparatus removed from the machine of FIG. 1.
Figure 4:
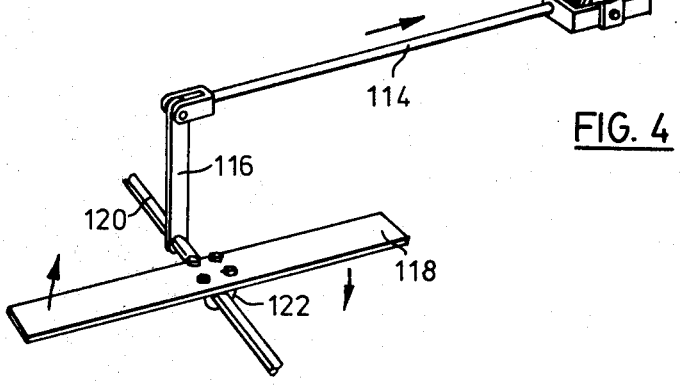
Figure 6:
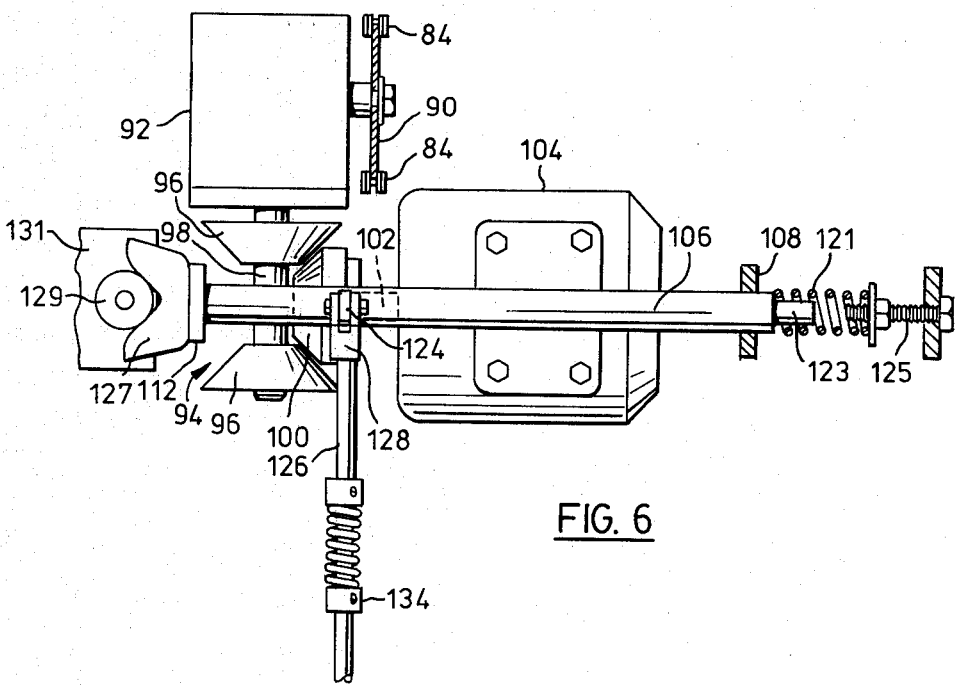
FIG. 6 is a plan view taken along lines 6—6 of FIG. 4.

As seen best in FIGS. 4 to 7, clutch 94 is biased into disengagement, so that the travel of cutting head 16 will stop when pressure is removed from foot pedal 118. Pivot shaft 106 is longitudinally slidably mounted in bearing blocks 108, and a spring 121 bears against the right hand end of pivot shaft 106 (as seen in FIGS. 6 and 7) to urge the pivot shaft to the left. Spring 121 is located on a reduced end portion 123 (see FIG. 2) of pivot shaft 106, and the compression or spring force of spring 121 is adjusted by a threaded retainer 125 coupled to the frame of machine 10. Referring in particular to FIGS. 5 and 6, link 112 extends above pivot shaft 106 and has a V-shaped centering cam 127 mounted at the top of link 112 spaced above the axis of pivot shaft 106. Cam 127 bears against a rotatable cam follower 129. As seen in FIG. 6, clutch 94 is disengaged when cam 127 is positioned so that cam follower 129 is in the apex of the V of the cam. As seen in FIG. 7, clutch 94 is engaged when cam follower 129 is not in the apex of the V-shaped cam 127. It will be appreciated that spring 121 biases cam 127 against cam follower 129, because cam 127 is attached to pivot shaft 106 through the extension of link 112, and spring 121 biases the pivot shaft toward cam follower 129. Therefore spring 121 biases cam 127 against cam follower 129 thereby urging clutch 94 into disengagement. Of course, cam 127 is moved relative to cam follower 129 by the pendulum motion of link 112, which in turn is primarily controlled by foot pedal 118 and intermediate links 114, 116.

Referring to FIG. 5, the position of cam follower 129 along the axis of pivot shaft 106 is adjusted by a sliding mounting plate 131 and a threaded adjusting bolt 133. This adjustment controls the horizontal spacing of clutch driving member 100 from the driven members 96. The horizontal spacing of the clutch driving and driven members affects the amount of travel or pivoting of foot pedal 118 and associated links required to engage and disengage the clutch. Wear of clutch driving member 100 may also be compensated for by this adjustment.

Means are also provided for limiting the travel of dolly 14 by automatically disengaging clutch 94 when cutting head 16 or dolly 14 reaches the extreme ends of its travel. An upright member 124 is attached to pivot shaft 106, and a rod 126 is pivotally attached to member 124 by a clevis 128. The opposite end of rod 126 is slidably mounted in frame 12 using an eccentric member 130 (see FIG. 1), which is provided for purposes of alignment of rod 126. Rod 126 passes through a bracket 132 attached to dolly 14. A pair of spring stops 134 are adjustably mounted on rod 126 to be engaged by bracket 132 as dolly 14 reaches the extreme left and right hand positions. It will be apparent (see FIG. 7) that when dolly 14 moves toward and engages one of the spring stops 134, upright member 124 will cause motor 104 to pivot to disengage clutch 94. As the stops 134 are engaged by bracket 132 of dolly 14, the operator feels his foot on foot pedal 118 being raised as clutch 94 is disengaging. This tactile signal tells the operator to discontinue his foot pressure on pedal 118 to allow dolly 14 to stop, or to alternate his foot pressure on the foot pedal to cause dolly 14 to reverse direction and continue moving. If the operator continues to apply foot pressure when the dolly engages one of the stops 134, then of course, clutch 94 will just slip until the foot pressure is released. A spring coupling 136 is provided at the connection of links 112, 114 to facilitate a smooth engagement of clutch 94. The springs of spring stops 134 similarly provide for a smooth disengagement of clutch 94. The location of stops 134 on rod 126 may be adjusted as desired to control the length of travel of dolly 14 on machine frame 12.

In using pelt fat removal machine 10, a pelt is mounted, inside out, on rear mandril 18, and the mandrils are rotated 180 degrees to bring the pelt into position to be worked on by cutting head 16. An operator then depresses foot pedal 118 to move cutting head 16 back and forth, at the same time manipulating lever 76 to adjust the depth of cut as required to remove the pelt fat. Cutting passes may be made in either direction of travel of cutting head 16, or the cutting head may be positioned at any intermediate point by appropriate manipulation of foot pedal 118. After the fat removal operation, the mandrils are again rotated 180 degrees, where the processed pelt is replaced with a fresh pelt to be processed.

Having described a preferred embodiment of the invention, it will be appreciated that various modifications may be made to the structure described. For example, the foot control for horizontal or longitudinal movement of the cutting head could be combined with the hand control for pivotal or transverse movement of the cutting head. This would provide a single joy stick type of control, where the control is moved longitudinally of the mandrils to produce respective longitudinal movement of the cutting head, and where the control is moved transversely for the pivotal cutting head movement described. For this purpose, the clutch engagement links could be combined or coupled to the lever and toggle joint to form the combined joy stick control. Also, although springs and cams are used for bias purposes, it will be appreciated that other forms of bias may be employed. For example, the pivoting axis of cutting head 16 could be off-set from the centre of gravity to provide gravity bias. It will also be appreciated that other forms of reversing clutches could be employed, if desired. Adjustable sprocket 86 could be mounted outboard of machine frame 12 to provide additional travel for dolly 14, if desired. Also, dolly 14 is shown having a triangular arrangement of guide wheels 48. Other arrangements of guide wheels or additional guide wheels could also be added. Finally, a positive resilient end stop could be provided to bear against dolly 14 at the end of its travel for more accurate positioning of the dolly.

From the above, it will be apparent that the present invention provides pelt fat removal apparatus that substantially reduces operator fatique. The operator may remain stationary, and even seated, to operate the machine. The result is substantially increased production of processed animal pelts.

What I claim as my invention is:

1. In a machine for removing fat from the inside of an animal pelt, the machine have a rotatable elongate mandril for mounting the pelt inside out thereon, a motor driven pelt engaging cutting head mounted on a dolly on the machine frame for longitudinal movement adjacent to the mandril, and the cutting head being pivotally mounted on the dolly for transverse adjustment of the depth of cut, apparatus for controlling the movement of the cutting head, said apparatus comprising: a control assembly adapted to be connected between the machine frame and the cutting head for pivotal movement of the cutting head relative to the dolly; the control assembly including a longitudinally rigid control member for connection to the cutting head, the control member including a transversely flexible extension portion and a remote end portion; a toggle joint operatively connected to said remote end portion to move the control member longitudinally and thus pivot the cutting head; and a lever operably attached to the toggle joint.

2. Apparatus as claimed in claim 1 and further comprising means for biasing the cutting head away from the pelt.

3. Apparatus as claimed in claim 1 wherein the control member is a cable for connection to the cutting head, the cable being slidably mounted on the dolly.

4. Apparatus as claimed in claim 1 wherein the toggle joint is movable from an open position to an over-the-centre closed position, and further comprising means for limiting the movement of the lever in said closed position.

5. Apparatus as claimed in claim 4 wherein said remote end portion of the control member is adjustably connected to the toggle joint.

6. In a machine for removing fat from the inside of an animal pelt, the machine having a rotatable elongate mandril for mounting the pelt inside out thereon, a motor driven pelt engaging cutting head mounted on a dolly on the machine frame for longitudinal movement adjacent to the mandril, and the cutting head being pivotally mounted on the dolly for transverse adjustment of the depth of cut, apparatus for controlling the movement of the cutting head, said apparatus comprising: a reciprocating element adapted to be connected to the dolly for longitudinal movement thereof; drive means operably connected to the reciprocating element, the drive means including a motor and a reversing clutch coupled between the motor and the reciprocating element; means operatively coupled to said clutch for engagement thereof to move the reciprocating element in alternative directions; and stops arranged to limit the longitudinal movement of the dolly, the stops being operatively connected to said clutch, so that upon contact of the stops by the dolly, said clutch is disengaged to prevent movement of the dolly past the stops.

7. Apparatus as claimed in claim 6 wherein said clutch includes a pair of opposed conical driven members and an intermediate mating driving member attached to the motor, the clutch being engaged by alternative contact of the driven members by said driving member.

8. Apparatus as claimed in claim 6 wherein said clutch engagement means comprises a foot operated control operatively coupled to said clutch, and further comprising means for biasing said clutch into disengagement.

9. Apparatus as claimed in claim 7 wherein said driving member is a generally conical resilient member attached to said motor drive shaft, and wherein the motor is pivotally mounted for alternative engagement of the driven members by the driving member, thereby permitting reversing engagement of said clutch.

10. Apparatus as claimed in claim 9 wherein the motor is mounted on a pivot shaft, and further comprising means operatively coupled to said pivot shaft for biasing the clutch driving member into disengagement.

11. Apparatus as claimed in claim 10 wherein said pivot shaft is longitudinally slidably mounted, and wherein said bias means comprises a V-shaped centering cam attached to the pivot shaft spaced from the axis thereof, a cam follower engaging said cam, and means for biasing the cam against the cam follower thereby urging said clutch driving member into disengagement.

12. Apparatus as claimed in claim 6 and further comprising: a control assembly adapted to be connected between the machine frame and the cutting head for pivotal movement of the cutting head relative to the dolly; the control assembly including a longitudinally rigid control member for connection to the cutting head, the control member including a transversely flexible extension portion and a remote end portion; a toggle joint operatively connected to said remote end portion to move the control member longitudinally and thus pivot the cutting head; and a lever operably attached to the toggle joint.

13. Apparatus as claimed in claim 12 wherein the control member is a cable for connection to the cutting head, the cable being slidably mounted on the dolly.

14. Apparatus as claimed in claim 13 wherein the toggle joint is movable from an open position to an over-the-centre closed position, and further comprising means for limiting the movement of the lever in said closed position.

15. Apparatus as claimed in claim 14 wherein said clutch engagement means is coupled to the toggle joint and lever to form a combined joy stick control.

* * * * *